United States Patent [19]

Steiman

[11] Patent Number: 4,494,546

[45] Date of Patent: Jan. 22, 1985

[54] MATERNITY BATHING SUIT

[76] Inventor: Nancy Steiman, 950½ 16th St., Santa Monica, Calif. 90403

[21] Appl. No.: 505,444

[22] Filed: Jun. 17, 1983

[51] Int. Cl.[3] ..... A41C 1/06; A41C 1/08

[52] U.S. Cl. ..... 128/431; 128/579 R; 2/67

[58] Field of Search ..... 128/431, 579, 546; 2/67, 76

[56] References Cited

U.S. PATENT DOCUMENTS 1,379,101 5/1921 Holt ..... 128/579 R
1,971,572 8/1934 Meeks ..... 2/76
3,234,947 2/1966 Bergstein .

FOREIGN PATENT DOCUMENTS 1375119 9/1964 France .

*Primary Examiner*—Doris L. Troutman
*Attorney, Agent, or Firm*—Pennie & Edmonds

[57] ABSTRACT

A woman's maternity garment, such as a bathing suit or the like, is provided, in the interior of the garment, with a first elastically deformable band spanning and supporting the wearer's lower abdominal region from hip to hip; and a second such band spanning and supporting the small of the back from side to side. Optionally, the garment is further provided with a third, narrower band spanning the wearer's chest from side to side, at the lower region of the portion of the garment covering the breasts, and supporting the breasts.

12 Claims, 4 Drawing Figures

MATERNITY BATHING SUIT

FIELD OF INVENTION

This invention pertains to an improved woman's garment, such as a bathing suit or the like, to be worn during pregnancy in order to ease its discomforts and permit the pregnant woman to engage in relatively vigorous physical activity.

BACKGROUND OF THE INVENTION

The pregnant woman experiences, as a rule, certain physical discomforts resulting from the extra weight and size of the developing baby which must be carried in the woman's abdominal area. Some woman, as a result, experience difficulties or unpleasantness on engaging in relatively vigorous physical activity, such as swimming, when they are in an advanced pregnant state.

It has generally been believed, in accordance with the prior art, that one method of easing the pregnant woman's discomfort is to provide physical support to the abdominal area. It has also sometimes been deemed desirable to provide support to the breasts, which during pregnancy often enlarge in preparation for lactation.

Maternity supporters and garments as known in the prior art are generally exemplified by U.S. Pat. No. 3,087,496 to B. L. Norman and U.S. Pat. No. 3,357,435 to S. F. Enrico.

Problems associated with maternity supporters and garments as known in the prior art include discomfort experienced by the wearer due to chafing, binding, irritation or loss of blood circulation. Such supporters and/or garments are generally ungainly and not pleasing in appearance, since they do not look like ordinary clothes.

OBJECTS OF THE INVENTION

It is therefore an object of the invention to provide an improved garment for a pregnant woman, such as a bathing suit or the like, which flexibly supports the abdominal region as it grows, while being soft and comfortable to wear; which makes the wearer stand straight, and yet affords ample room to breathe, as well as growing room for the baby; which helps maintain correct posture; which provides support to the breasts; which is modern looking and attractive in appearance; and which accomplishes these objects by providing support optimally localized to the areas of the body which require it, without unduly affecting others areas of the body or adversely affecting blood circulation, and without affecting the external appearance of the garment as a whole.

BRIEF DESCRIPTION OF THE INVENTION

The invention accomplishes the foregoing objects by providing, in a woman's garment such as a bathing suit or the like, in the interior of the garment, a first elastically deformable band spanning and supporting the wearer's lower abdominal region from hip to hip; and a second such band spanning and supporting the small of the back from side to side. Optionally, the garment is further provided with a third, narrower band spanning the chest from side to side, at the lower region of the portion of the garment designed to cover the breasts, for support of the breasts.

DESCRIPTION OF THE FIGURES

The invention will be further explained with reference to the accompanying figures, in which.

DETAILED DESCRIPTION OF A PREFERRED EMBODIMENT

The invention will now be explained in detail, with reference to the accompanying figures.

Figure 2:
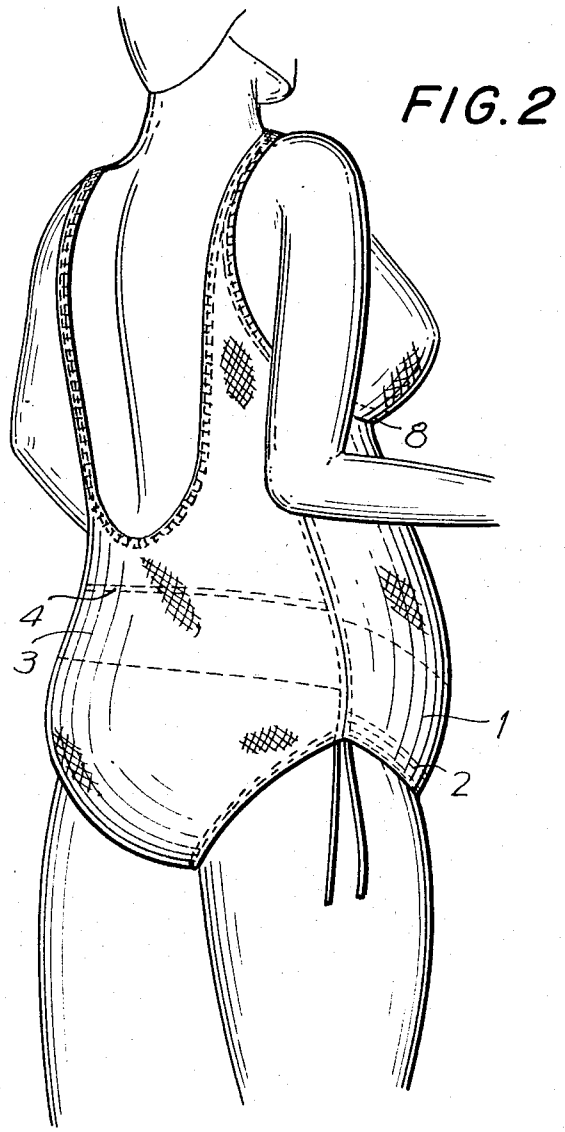
FIG. 2 is a rear right hand perspective view of a woman wearing a bathing suit according to the embodiment.
Figure 1:
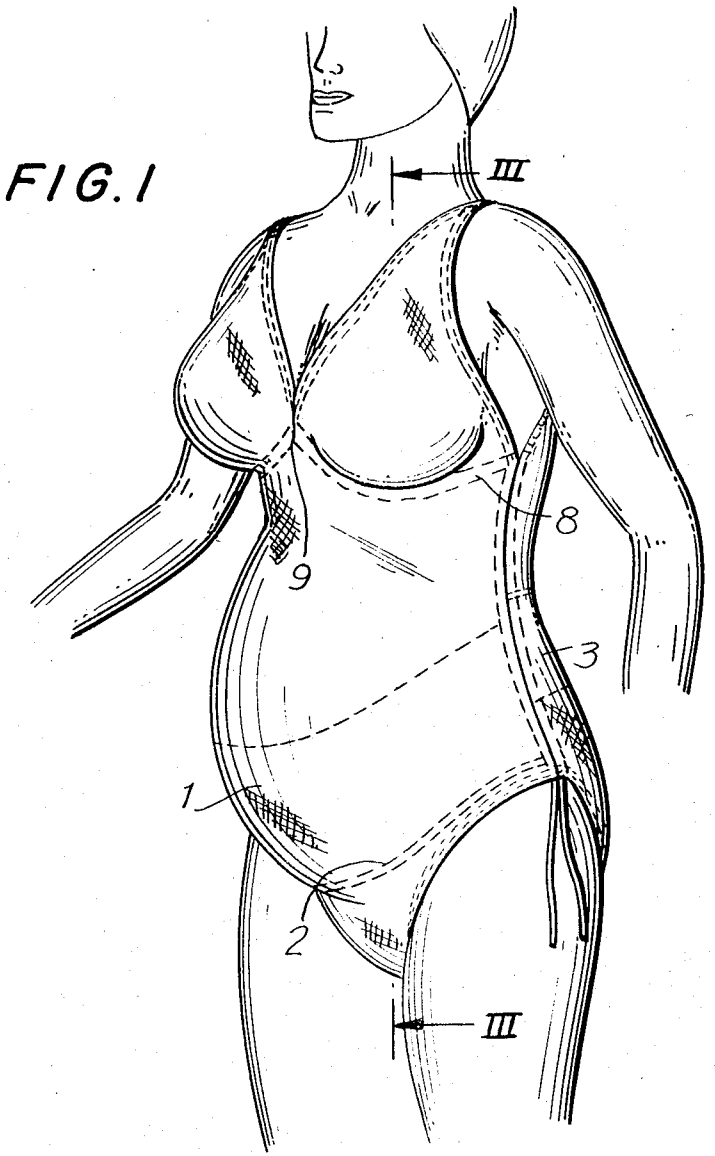
FIG. 1 is a front left hand perspective view of a woman wearing a bathing suit according to an embodiment of the invention.

FIG. 1 and FIG. 2 are perspective views of a woman wearing a bathing suit according to an embodiment of the invention, in which the interior construction of the bathing suit is indicated by appropriate dashed lines.

A band 1 of elastically deformable material is provided in the interior of the bathing suit, spanning the wearer's lower abdominal region from hip to hip. This band is optimally made of 10% rubber, 70% polyester and 20% nylon. Material for such a band is commercially available from George C. Moore Company, Westerly, R.I. under stock No. 894N. Its elasticity is about 125 percent. Band 1 is approximately four inches wide. It is fixed to the interior of the suit by any convenient means, such as sewing, along the left hand and right hand side seams of the suit. At its lower edge, it may also be affixed to the suit by any convenient means, such as sewn seam 2. It is advantageous not to affix the upper edge to the suit, in order to avoid unnecessary binding or wrinkling.

As can be seen by reference to FIG. 2, a supporting band 3 is provided across the small of the back of the wearer; that is, the area approximately from the third lumbar vertebra to the lower part of the sacrum. This band is advantageously made of 20% nylon, 73% polyester and 7% spandex and is three inches in width. Material for such a band is commercially available from the said George C. Moore Company (stock No. 300P). Its elasticity is about 135 percent. Band 3 is advantageously affixed at its ends to the side seams of the suit by any convenient means, such as sewing. Its top edge may be similarly affixed to the suit as by sewn seam 4. Again, it is advantageous not to affix the lower edge to the suit, for the reasons above described with reference to band 1.

The elastic material chosen for bands 1 and 2 should be chosen and cut such that it is elastically deformable with respect to the long axis of each of bands 1 and 3, but not normal thereto. In this manner, the combination of bands 1 and 3 generally defines a circle about the abdominal region of the wearer, which is circumferentially expandable, while being resistant to expansion generally along the vertical axis defined by the spine of the wearer. This object is attained because the materials chosen for the bands are generally elastically deformable in one direction, but not normal thereto. Note, however, that while bands 1 and 3 generally define a circle, their ends are offset with respect to such other, in order to enable band 1 optimally to support the wearer's lower abdominal region and band 3 to support the small of the back.

Figure 4:
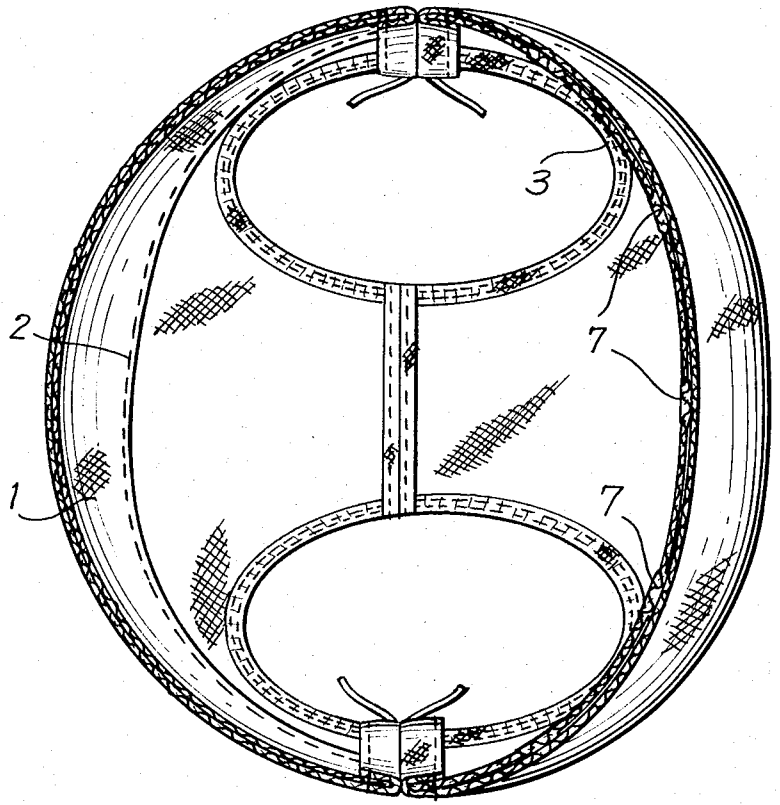
FIG. 4 is a cross-sectional view of a bathing suit, taken along line IV—IV of FIG. 3.
Figure 3:
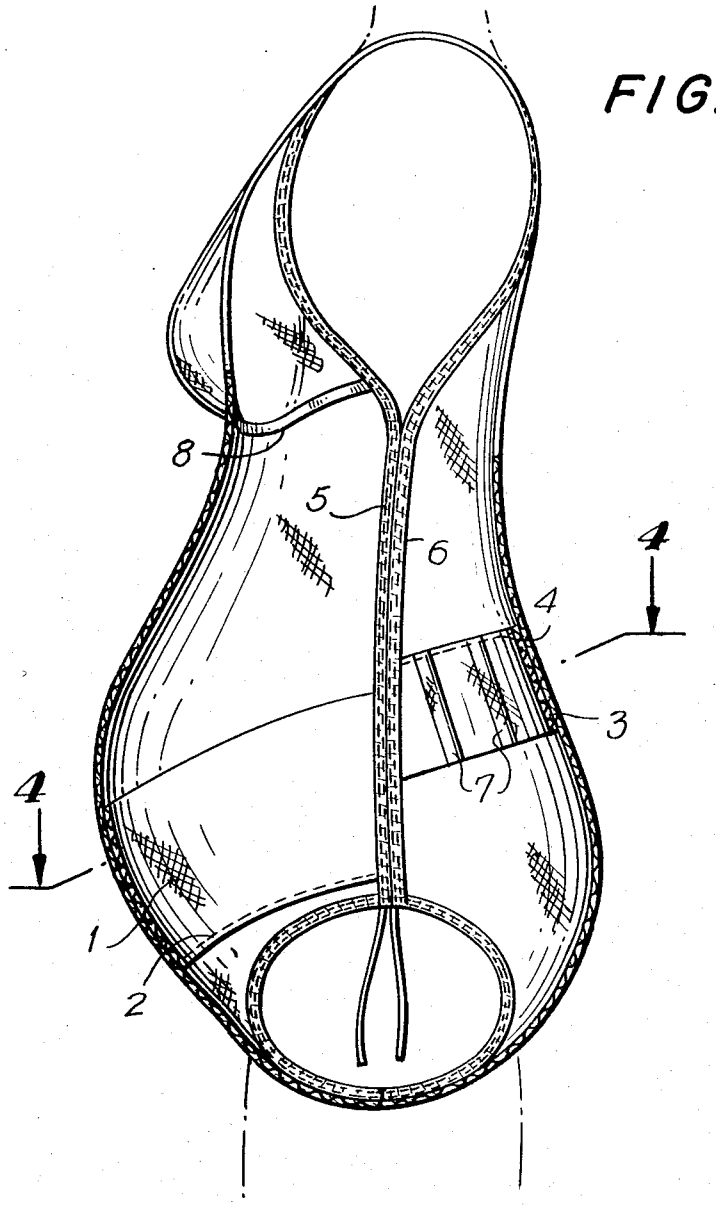
FIG. 3 is a cross-sectional view of a bathing suit, taken along line III—III of FIG. 1.

The manner in which bands 1 and 3 are fixed to the interior of the bathing suit is more fully apparent with reference to FIG. 3, which discloses the attachment of bands 1 and 3 to the suit by means of sewing thread seams 2, 4, 5 and 6. Band 3 is advantageously provided with stiffener sections 7 each being approximately one-half inch in width. Note the manner in which stiffener sections 7 are arrayed on band 3, advantageously being approximately 2½ inches on center. As is apparent from FIG. 4, stiffener sections 7 comprise thickened, and hence reinforced, areas of band 3. Alternatively, such reinforcement could be achieved with non-integral stiffeners, such as sewn-on strips.

Again with reference to FIG. 1, the bathing suit or the like may optionally be provided with a strip 8 of elastically deformable material, such as 10% nylon, 81% polyester and 9% spandex, in the inside of the suit at the lower portion of the region intended to cover the wearer's breasts (the bust region). Strip 8 may be advantageously ¾ inch in width, and should be so chosen and cut so that it is elastically deformable along its long axis, but not normal thereto. Suitable material for Strip 8 is commercially available from the said George C. Moore Company (stock no. 901). Strip 8 may be affixed to the suit along the left and right hand seams thereof, by any convenient means such as sewing, and may further be affixed to the suit at the region of suit designed to cover the sternum of the wearer, denoted on FIG. 1 as point 9.

The invention is not limited to the exact embodiments above described, but encompasses such further embodiments or variations as would be obvious to one skilled in the art. For example, a similarly constructed garment may be created in the form of a leotard, an undergarment, or a warm-up suit.

I claim:

1. In a maternity garment having a front portion and a back portion each having left and right sides joined to each other at left and right side seams, the improvement comprising first and second bands, each consisting substantially only of elastically deformable material, said first band supporting the lower abdomen of the wearer in the uterine area, and said second band supporting the small of the wearer's back, said bands being substantially rectangular and having left and right ends and upper and lower edges, said ends of the first and second bands being connected respectively to the front and back portions of the garment and to each other at said side seams, and the respective ends of the first and second bands being offset from each other, with the upper edge of the second band positioned higher on the body of the wearer than the upper edge of the first band.

2. A garment as in claim 1, wherein said first band is attached to the front portion of the garment at the lower edge of the band, and the second band is attached to the back portion of the garment at the upper edge of the band.

3. A garment as in claim 1, wherein said second band is located on the garment so as to be positioned approximately on the region of the wearer's back from the third lumbar vertebra to the bottom of the sacrum.

4. A garment as in claim 3, wherein the dimensions between the bottom edges and top edges of said first and second bands are approximately 4 inches and 3 inches, respectively.

5. A garment as in claim 1, wherein the dimensions between the bottom edges and top edges of said first and second bands are approximately 4 inches and 3 inches, respectively.

6. A garment as in claim 1, wherein the elasticities of said first and second bands are approximately 125 percent and 135 percent, respectively.

7. A garment as in claim 6, wherein the first band is made substantially of 10 percent rubber, 70 percent polyester, and 20 percent Nylon, and the second band is made of 20 percent Nylon, 73 percent polyester, and 7 percent Spandex.

8. A garment as in claim 1, wherein said left ends of said bands and said left garment sides are interconnected at a single sewn seam, and said right ends of said bands and said right garment sides are interconnected at another single sewn seam.

9. A garment as in claim 1, wherein said second band further comprises a plurality of vertical stiffener sections between said band ends.

10. A garment as in claim 9, wherein said stiffener sections are integral with said second band.

11. A garment as in claim 1, wherein (a) the first band (i) is made substantially of 10 percent rubber, 70 percent polyester, and 20 percent Nylon and has an elasticity of approximately 125 percent,
(ii) is attached to the front portion of the garment at the lower edge of the band, and
(iii) has a vertical dimension of approximately 4 inches, (b) the second band (i) is made substantially of 20 percent Nylon, 73 percent polyester, and 7 percent Spandex and has an elasticity of approximately 135 percent,
(ii) is attached to the back portion of the garment at the upper edge of the band, and
(iii) has a vertical dimension of approximately 3 inches, (c) said left ends of said bands and said left garment side are interconnected at a single sewn seam, and said right ends of said bands and said right garment side are interconnected at another single sewn seam, (d) said second band is located on the garment so as to be positioned substantially on the small of the wearer's back, and (e) said second band includes a plurality of integral vertical stiffener sections.

12. A garment as in claim 1, wherein (a) the first band (i) is made substantially of 10 percent rubber, 70 percent polyester, and 20 percent Nylon and has an elasticity of approximately 125 percent,
(ii) is attached to the front portion of the garment at the lower edge of the band, and
(iii) has a vertical dimension of approximately 4 inches, (b) the second band (i) is made substantially of 20 percent Nylon, 73 percent polyester, and 7 percent Spandex and has an elasticity of approximately 135 percent,
(ii) is attached to the back portion of the garment at the upper edge of the band, and
(iii) has a vertical dimension of approximately 3 inches, (c) said left ends of said bands and said left garment side are interconnected at a single sewn seam, and said right ends of said bands and said right garment side are interconnected at another single sewn seam, (d) said second band is located on the garment so as to be positioned approximately on the region of the wearer's back from the third lumbar vertebra to the bottom of the sacrum, and (e) said second band includes a plurality of integral vertical stiffener sections.

* * * * *